US009355595B2

(12) United States Patent
Qi et al.

(10) Patent No.: US 9,355,595 B2
(45) Date of Patent: May 31, 2016

(54) PIXEL UNIT DRIVING CIRCUIT HAVING AN ERASING TRANSISTOR AND MATCHING TRANSISTOR, AND METHOD THEREOF

(71) Applicants: BOE Technology Group Co., Ltd., Beijing (CN); Chengdu BOE Optoelectronics Technology Co., Ltd., Chengdu (CN)

(72) Inventors: Xiaojing Qi, Beijing (CN); Haigang Qing, Beijing (CN); Tianma Li, Beijing (CN)

(73) Assignees: BOE TECHNOLOGY GROUP CO., LTD., Beijing (CN); CHENGDU BOE OPTOELECTRONICS TECHNOLOGY CO., LTD., Sichuan (CN)

( * ) Notice: Subject to any disclaimer, the term of this patent is extended or adjusted under 35 U.S.C. 154(b) by 134 days.

(21) Appl. No.: 13/993,637

(22) PCT Filed: Dec. 6, 2012

(86) PCT No.: PCT/CN2012/086019

§ 371 (c)(1),
(2) Date: Jun. 12, 2013

(87) PCT Pub. No.: WO2013/123795

PCT Pub. Date: Aug. 29, 2013

(65) Prior Publication Data

US 2014/0055325 A1 Feb. 27, 2014

(30) Foreign Application Priority Data

Feb. 21, 2012 (CN) ..... 2012 1 0041261

(51) Int. Cl.
*G09G 3/32* (2006.01)
*H05B 33/08* (2006.01)

(52) U.S. Cl.
CPC ..... *G09G 3/3258* (2013.01); *G09G 3/3233* (2013.01); *H05B 33/0896* (2013.01);

(Continued)

(58) Field of Classification Search
USPC ..... 345/76, 82
See application file for complete search history.

(56) References Cited

U.S. PATENT DOCUMENTS

2004/0080475 A1* 4/2004 Yoshida ..... 345/82
2007/0040770 A1 2/2007 Kim (Continued)

FOREIGN PATENT DOCUMENTS

CN 101059932 A 10/2001
CN 1917015 A 2/2007

(Continued)

OTHER PUBLICATIONS

International Search Report (Chinese language) issued by the International Searching Authority, rendered Mar. 14, 2013, 11 pages.

(Continued)

*Primary Examiner* — Long D Pham

(57) ABSTRACT

A pixel unit driving circuit and a method thereof, a pixel unit and a display apparatus can improve uniformity in the brightness of an OLED panel. The pixel unit driving circuit comprises a driving thin film transistor (DTFT), a matching thin film transistor (MTFT), a signal-erasing thin film transistor (ETFT), a charging control unit (31), a driving control unit (32) and a storage capacitor (Cs). A gate of the driving thin film transistor (DTFT) is connected with a first end of the storage capacitor (Cs) and is connected with a driving power supply (VDD) via the charging control unit (32), a source thereof is connected with a driving power supply (VSS), and a drain thereof is connected with the OLED. A gate and drain of the signal-erasing thin film transistor (ETFT) is connected with the second end of the storage capacitor (Cs), a source of the signal-erasing thin film transistor (ETFT) is connected with the gate and the drain of the matching thin film transistor, and is connected with the data line via the charging control unit (31). A source of the matching thin film transistor (MTFT) is connected with a second end of the storage capacitor (Cs).

4 Claims, 7 Drawing Sheets

(52) U.S. Cl.
CPC ..... *G09G2300/0819* (2013.01); *G09G 2300/0842* (2013.01); *G09G 2310/0262* (2013.01); *G09G 2320/0233* (2013.01); *G09G 2320/043* (2013.01)

(56) References Cited

U.S. PATENT DOCUMENTS

| | | | | |
|---|---|---|---|---|
| 2007/0085782 | A1* | 4/2007 | Matsumoto et al. | 345/76 |
| 2007/0242016 | A1 | 10/2007 | Choi | |
| 2008/0001857 | A1* | 1/2008 | Yoo | 345/76 |
| 2010/0177125 | A1* | 7/2010 | Miwa | 345/690 |
| 2011/0115764 | A1 | 5/2011 | Chung | |
| 2011/0157147 | A1* | 6/2011 | Tsai | 345/213 |

FOREIGN PATENT DOCUMENTS

| | | | |
|---|---|---|---|
| CN | 102708792 | A | 10/2012 |
| KR | 1066490 | B1 | 9/2011 |

OTHER PUBLICATIONS

English abstract of CN102708792(A), 1 page.

English translation of KR1066490(B1), 2 pages.

English abstract of CN1917015(a), 1 page.

English abstract of CN101059932(a), 1 page.

First Office Action (Chinese language) for priority application No. CN 201210041261.9 issued by the State Intellectual Property Office ("SIPO") Feb. 25, 2014, 5 pages.

English translation of the First Office Action issued by SIPO, 1 page.

International Preliminary Report on Patentability for International Application No. PCT/CN2012/086019 dated Aug. 26, 2014, 7pgs.

* cited by examiner

PIXEL UNIT DRIVING CIRCUIT HAVING AN ERASING TRANSISTOR AND MATCHING TRANSISTOR, AND METHOD THEREOF

CROSS REFERENCE TO RELATED APPLICATIONS

This application is based on International Application No. PCT/CN2012/086019 filed on Dec. 6, 2012, which claims priority to Chinese National Application No. 201210041261.9 filed on Feb. 21, 2012, the contents of which are incorporated herein by reference.

TECHNICAL FIELD

The present disclosure relates to a field of liquid crystal displaying, and in particularly, to a pixel unit driving circuit and a method thereof, a pixel unit and a display apparatus.

BACKGROUND

An Active Matrix Organic Light Emitting Diode (AMOLED) may emit light because it is driven by a current generated when a driving TFT is in a saturation state. Different critical voltages would generate different driving currents when a same gray scale voltage is input, and this leads to an inconsistency in the currents. A uniformity in threshold voltages (Vth) of transistors during a process of Low-Temperature PolySilicon is very poor, and the Vth may further drift, and thus the uniformity in a conventional 2T1C pixel unit driving circuit is always poor.

The conventional 2T1C pixel unit driving circuit is as illustrated in FIG. 1, and this circuit only comprises two TFTs wherein a T1 functions as a switch and a DTFT is used for driving the pixel. Operations of the conventional 2T1C pixel unit driving circuit is also simple, and a control timing of the 2T1C pixel unit driving circuit is illustrated in FIG. 2. T1 is turned on when a scan level Vscan on a scan line Scan is low, and a gray scale voltage Vdata on a data line Data charges a capacitor C, while the T1 is turned off when the scan level Vscan is high, and the capacitor C is used for holding the gray scale voltage. Because VDD (an output voltage at a high level output terminal of a driving power supply) is high, the DTFT is in the saturation state, and a driving current of the OLED is $I=K(Vsg-|Vth|)^2=K(VDD-Vdata-|Vth|)^2$, wherein Vdata is a data voltage output from the data line Data, K is a constant related to a size of the transistor and a mobility of carriers, and the K would be determined once the size of the TFT and manufacture process are determined. The formula for the driving current in the 2T1C circuit comprises the Vth, therefore in such a driving scheme, brightness at different positions on a panel varies and the uniformity in the brightness is poor, and the reasons are in that, as described previously, the Vths of the TFTs at different positions on the panel would vary largely even if the TFTs are manufactured with the same process parameters, since a process of the LTPS is imperfect, such that the driving currents of the OLED under a same gray scale voltage vary.

SUMMARY

The present disclosure provides a pixel unit driving circuit and a method thereof, a pixel unit and a display apparatus, in order to improve uniformity in a brightness of an OLED panel.

According to an aspect, the present disclosure provides a pixel unit driving circuit for driving an OLED, comprising a driving thin film transistor, a matching thin film transistor, a signal-erasing thin film transistor, a charging control unit, a driving control unit and a storage capacitor, wherein:

a gate of the driving thin film transistor is connected with a first end of the storage capacitor and is connected with a low level output terminal of a driving power supply via the charging control unit, a source thereof is connected with the low level output terminal of the driving power supply, and a drain thereof is connected with a cathode of the OLED;

a gate and a drain of the matching thin film transistor are connected with a data line via the charging control unit, and a source thereof is connected with a second end of the storage capacitor;

a gate and a drain of the signal-erasing thin film transistor are connected with the second end of the storage capacitor;

a source of the signal-erasing thin film transistor is connected with the gate and the drain of the matching thin film transistor, and is connected with the data line via the charging control unit;

the second end of the storage capacitor is connected with a high level output terminal of the driving power supply via the driving control unit; and the driving thin film transistor, the matching thin film transistor and the signal-erasing thin film transistor are n-type TFTs.

According to an embodiment of the present disclosure, the charging control unit comprises a first thin film transistor and a second thin film transistor, and the driving control unit comprises a third thin film transistor;

the gate and the drain of the matching thin film transistor, the source of the signal-erasing thin film transistor are connected with the data line via the first thin film transistor;

the gate of the driving thin film transistor is connected with the low level output terminal of the driving power supply via the second thin film transistor; and the second end of the storage capacitor is connected with the high level output terminal of the driving power supply via the third thin film transistor.

According to one embodiment of the present disclosure, the first thin film transistor, the second thin film transistor and the third thin film transistor are n-type TFTs;

a gate of the first thin film transistor is connected with a first control line, a drain thereof is connected with the data line;

a source of the first thin film transistor is connected with the gate and the drain of the matching thin film transistor, and the source of the signal-erasing thin film transistor, respectively;

a gate of the second thin film transistor is connected with the first control line, a source thereof is connected with the low level output terminal of the driving power supply, and a drain thereof is connected with the gate of the driving thin film transistor;

a gate of the third thin film transistor is connected with a second control line, a source thereof is connected with the second end of the storage capacitor, and a drain thereof is connected with the high level output terminal of the driving power supply.

According to another aspect, the present disclosure further provides a pixel unit driving method applied to the pixel unit driving circuit described above, comprising:

controlling the charging control unit so that the signal-erasing thin film transistor is turned on and the storage capacitor discharges the data line through the signal-erasing thin film transistor until the voltage at the second end of the storage capacitor drops so as to turn off the signal-erasing thin film transistor, and controlling the charging control unit so that the gate of the driving thin film transistor is pulled-down to the voltage VSS output from the low level output terminal of the driving power supply;

controlling the charging control unit, so that the matching thin film transistor is turned on and a data voltage Vdata output from the data line charges the storage capacitor until the voltage at the second end of the storage capacitor rises to be equal to a voltage difference Vdata−Vthm between the data voltage and a threshold voltage of the matching thin film transistor;

controlling the driving control unit so that the voltage at the second end of the storage capacitor is pulled-up to a voltage VDD output from the high level output terminal of the driving power supply, and controlling the charging control unit so that the gate of the driving thin film transistor is in a float state so as to turn on the driving thin film transistor.

According to a still aspect, the present disclosure further provides a pixel unit comprising a OLED and the pixel unit driving circuit described above, a cathode of the OLED is connected with a drain of a driving thin film transistor in the pixel unit driving circuit, and an anode of the OLED is connected with the high level output terminal of the driving power supply.

According to a further aspect, the present disclosure further provides a display apparatus comprising the pixel unit described above.

According to another aspect, the present disclosure further provides a pixel unit driving circuit for driving an OLED, comprising a driving thin film transistor, a matching thin film transistor, a signal-erasing thin film transistor, a charging control unit, a driving control unit and a storage capacitor, wherein:

a gate of the driving thin film transistor is connected with a first end of the storage capacitor and is connected with a high level output terminal of a driving power supply via the charging control unit, a source thereof is connected with the high level output terminal of the driving power supply, and a drain thereof is connected with an anode of the OLED;

a gate and a source of the matching thin film transistor are connected with a data line via the charging control unit, and a drain thereof is connected with a second end of the storage capacitor;

a gate and a source of the signal-erasing thin film transistor are connected with the second end of the storage capacitor;

a drain of the signal-erasing thin film transistor is connected with the gate and the source of the matching thin film transistor, and is connected with the data line via the charging control unit;

the second end of the storage capacitor is connected with a low level output terminal of the driving power supply via the driving control unit;

the driving thin film transistor, the matching thin film transistor and the signal-erasing thin film transistor are p-type TFTs.

According to an embodiment of the present disclosure, the charging control unit comprises a first thin film transistor and a second thin film transistor, and the driving control unit comprises a third thin film transistor;

the gate and the source of the matching thin film transistor, the drain of the signal-erasing thin film transistor are connected with the data line via the first thin film transistor;

the gate of the driving thin film transistor is connected with the high level output terminal of the driving power supply via the second thin film transistor;

the second end of the storage capacitor is connected with the low level output terminal of the driving power supply via the third thin film transistor.

According to one embodiment of the present disclosure, the first thin film transistor, the second thin film transistor and the third thin film transistor are p-type TFTs;

a gate of the first thin film transistor is connected with a first control line, and a source thereof is connected with the data line;

a drain of the first thin film transistor is connected with the gate and the source of the matching thin film transistor, and the drain of the signal-erasing thin film transistor, respectively;

a gate of the second thin film transistor is connected with the first control line, a source thereof is connected with the high level output terminal of the driving power supply, and a drain thereof is connected with the gate of the driving thin film transistor;

a gate of the third thin film transistor is connected with a second control line, a source thereof is connected with the second end of the storage capacitor, and a drain thereof is connected with the low level output terminal of the driving power supply.

According to another aspect, the present disclosure further provides a pixel unit driving method applied to the pixel unit driving circuit described above, comprising:

controlling the charging control unit so that the signal-erasing thin film transistor is turned on and the data line charges the storage capacitor through the signal-erasing thin film transistor until a voltage at a second end of the storage capacitor rises so as to turn off the signal-erasing thin film transistor, and controlling the charging control unit so that a gate of the driving thin film transistor is pulled-up to the voltage VDD output from a high level output terminal of the driving power supply;

controlling the charging control unit, so that the matching thin film transistor is turned on and the storage capacitor discharges the data line through the matching thin film transistor until the voltage at the second end of the storage capacitor drops to be equal to a voltage sum Vdata+|Vthm| of the data voltage output from the data line and a threshold voltage of the matching thin film transistor;

controlling the driving control unit so that the voltage at the second end of the storage capacitor is pulled-down to a voltage VSS output from the low level output terminal of the driving power supply, and controlling the charging control unit so that the gate of the driving thin film transistor is in a float state so as to turn on the driving thin film transistor.

The present disclosure further provides a pixel unit comprising an OLED and the pixel unit driving circuit described above, an anode of the OLED is connected with a drain of the driving thin film transistor in the pixel unit driving circuit, and a cathode of the OLED is connected with the low level output terminal of the driving power supply.

The present disclosure further provides a display apparatus comprising the pixel unit described above.

As compared with the prior art, the pixel unit driving circuit and method thereof, the pixel unit and the display apparatus of the present disclosure may compensate a critical voltage of the OLED driving transistor with a principle that electrical properties of two TFTs designed similarly in a same pixel match to each other, and improve the non-uniformity in the brightness of an OLED panel.

DETAILED DESCRIPTION

Figure 1:
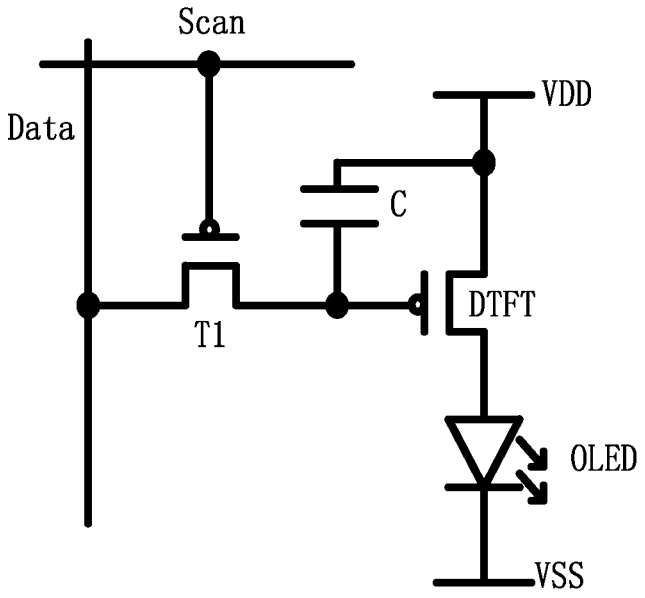
FIG. 1 is a circuit diagram of a conventional 2T1C pixel unit driving circuit.
Figure 2:
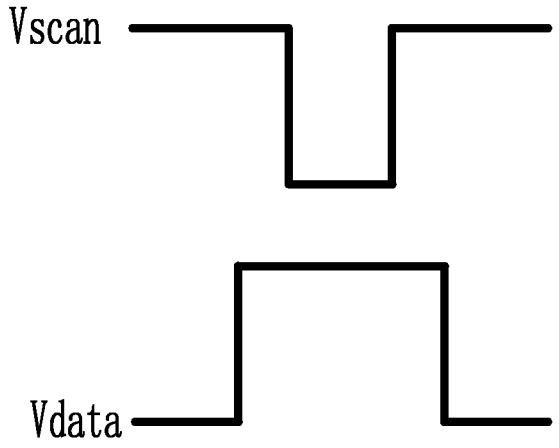
FIG. 2 is a control timing diagram of the conventional 2T1C pixel unit driving circuit.
Figure 3:
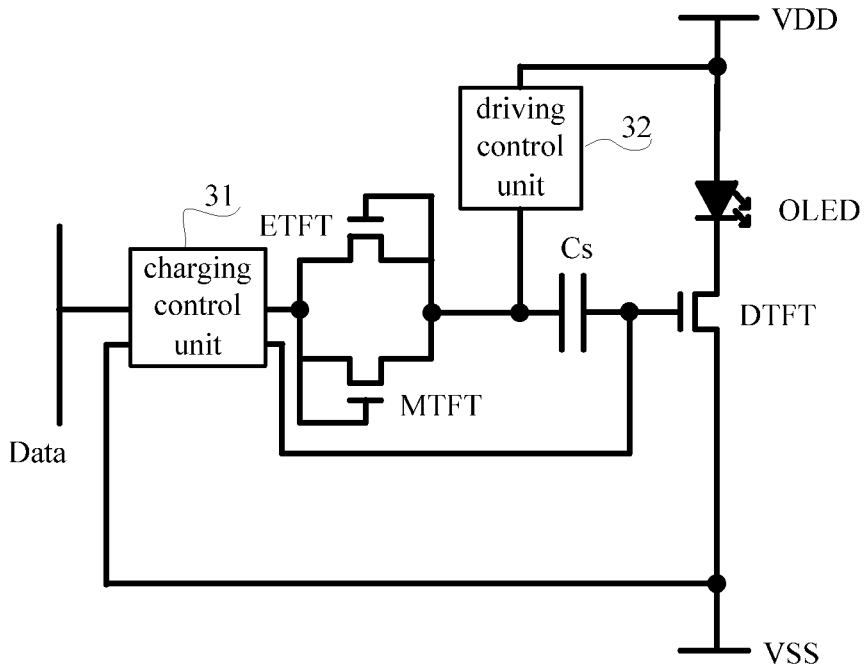
FIG. 3 is a circuit diagram of a pixel unit driving circuit according to a first embodiment of the present disclosure.

As illustrated in FIG. 3, a pixel unit driving circuit according to a first embodiment of the present disclosure for driving an OLED comprises a driving thin film transistor DTFT, a matching thin film transistor MTFT, a signal-erasing thin film transistor ETFT, a charging control unit 31, a driving control unit 32 and a storage capacitor Cs, wherein:

a gate of the driving thin film transistor DTFT is connected with a first end of the storage capacitor Cs and is further connected with a low level output terminal of a driving power supply via the charging control unit 31, a source of the driving thin film transistor DTFT is connected with the low level output terminal of the driving power supply, and a drain thereof is connected with a cathode of the OLED;

a gate and a drain of the matching thin film transistor MTFT are connected with a data line Data via the charging control unit 31, and a source thereof is connected with a second end of the storage capacitor Cs;

a gate and a drain of the signal-erasing thin film transistor ETFT are connected with the second end of the storage capacitor Cs;

a source of the signal-erasing thin film transistor ETFT is connected with the gate and the drain of the matching thin film transistor MTFT, and is connected with the data line Data via the charging control unit 31;

the second end of the storage capacitor Cs is connected with a high level output terminal of the driving power supply via the driving control unit 32;

an anode of the OLED is connected with the high level output terminal of the driving power supply;

the driving thin film transistor DTFT, the matching thin film transistor MTFT and the signal-erasing thin film transistor ETFT are n-type TFTs; an output voltage at the high level output terminal of the driving power supply is VDD, and an output voltage at the low level output terminal of the driving power supply is VSS.

Figure 4:
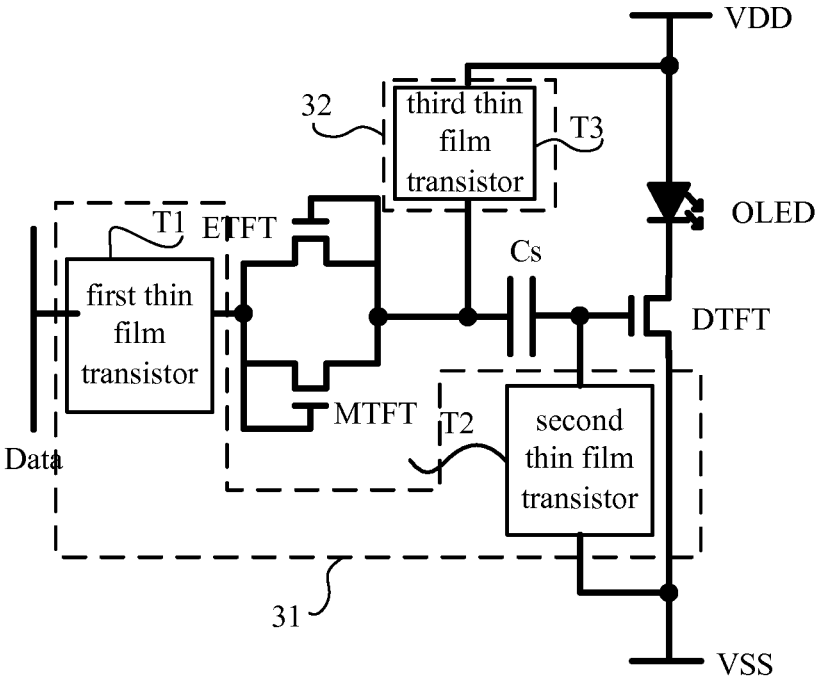
FIG. 4 is a circuit diagram of a pixel unit driving circuit according to a second embodiment of the present disclosure.

FIG. 4 is a circuit diagram of a pixel unit driving circuit according to a second embodiment of the present disclosure. The pixel unit driving circuit according to the second embodiment of the present disclosure is based on the pixel unit driving circuit according to the first embodiment of the present disclosure.

In the pixel unit driving circuit according to the second embodiment of the present disclosure, the charging control unit 31 comprises a first thin film transistor T1 and a second thin film transistor T2, and the driving control unit 32 comprises a third thin film transistor T3;

the gate and the drain of the matching thin film transistor MTFT, the source of the signal-erasing thin film transistor ETFT are connected with the data line Data via the first thin film transistor T1;

the gate of the driving thin film transistor DTFT is connected with the low level output terminal of the driving power supply via the second thin film transistor T2;

the second end of the storage capacitor Cs is connected with the high level output terminal of the driving power supply via the third thin film transistor T3.

Figure 5:
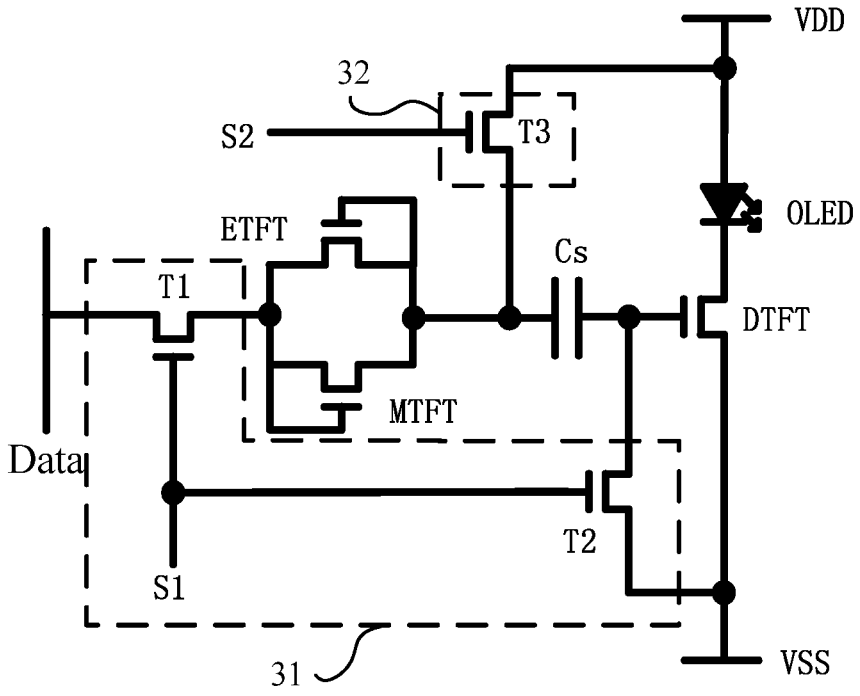
FIG. 5 is a circuit diagram of a pixel unit driving circuit according to a third embodiment of the present disclosure.

FIG. 5 is a circuit diagram of a pixel unit driving circuit according to a third embodiment of the present disclosure. The pixel unit driving circuit according to the third embodiment of the present disclosure is based on the pixel unit driving circuit according to the second embodiment of the present disclosure.

In the pixel unit driving circuit according to the third embodiment of the present disclosure, the first thin film transistor T1, the second thin film transistor T2 and the third thin film transistor T3 are n-type TFTs;

a gate of the first thin film transistor T1 is connected with a first control line for outputting a first control signal S1, and a drain thereof is connected with the data line Data;

a source of the first thin film transistor T1 is connected with the gate and the drain of the matching thin film transistor MTFT, and the source of the signal-erasing thin film transistor ETFT, respectively;

a gate of the second thin film transistor T2 is connected with the first control line, a source thereof is connected with the low level output terminal of the driving power supply, a drain thereof is connected with the gate of the driving thin film transistor DTFT;

a gate of the third thin film transistor T3 is connected with a second control line for outputting a second control signal S2, a source thereof is connected with the second end of the storage capacitor Cs, and a drain thereof is connected with the high level output terminal of the driving power supply.

Figure 6:
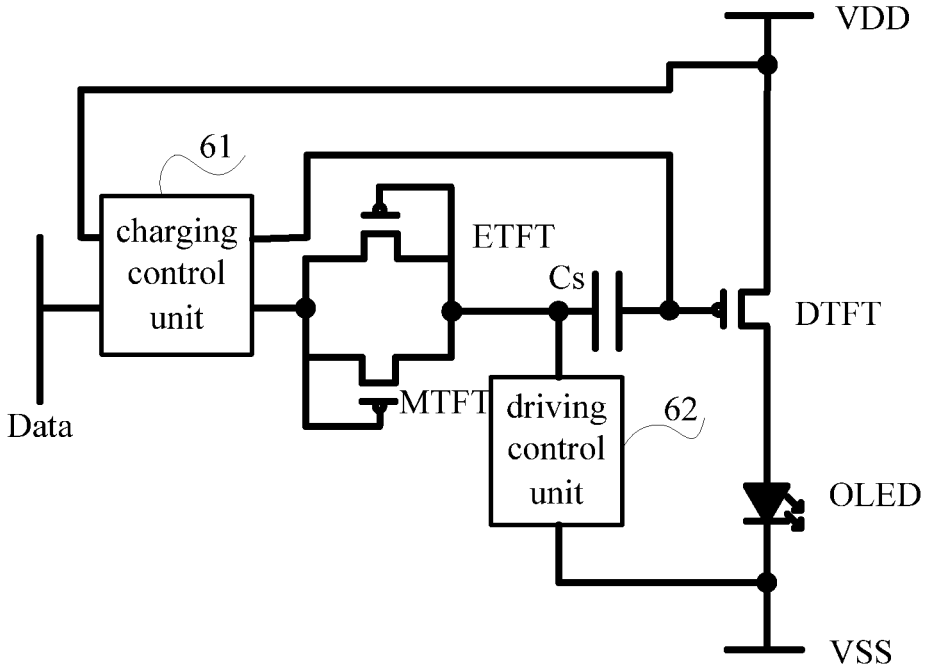
FIG. 6 is a circuit diagram of a pixel unit driving circuit according to a fourth embodiment of the present disclosure.

FIG. 6 illustrates a pixel unit driving circuit according to a fourth embodiment of the present disclosure, which is used for driving an OLED and comprises a driving thin film transistor DTFT, a matching thin film transistor MTFT, a signal-erasing thin film transistor ETFT, a charging control unit 61, a driving control unit 62 and a storage capacitor Cs, wherein:

a gate of the driving thin film transistor DTFT is connected with a first end of the storage capacitor Cs and is further connected with a high level output terminal of a driving power supply via the charging control unit 61;

a source of the driving thin film transistor DTFT is connected with the high level output terminal of the driving power supply, a drain thereof is connected with an anode of the OLED;

a gate and a source of the matching thin film transistor MTFT are connected with a data line Data via the charging control unit 61, and a drain thereof is connected with a second end of the storage capacitor Cs;

a gate and a source of the signal-erasing thin film transistor ETFT are connected with the second end of the storage capacitor Cs;

a drain of the signal-erasing thin film transistor ETFT is connected with the gate and the source of the matching thin film transistor MTFT, and is connected with the data line Data via the charging control unit 61;

the second end of the storage capacitor Cs is connected with a low level output terminal of the driving power supply via the driving control unit 62;

a cathode of the OLED is connected with the low level output terminal of the driving power supply;

the driving thin film transistor DTFT, the matching thin film transistor MTFT and the signal-erasing thin film transistor ETFT are p-type TFTs;

an output voltage at the high level output terminal of the driving power supply is VDD, and an output voltage at the low level output terminal of the driving power supply is VSS.

Figure 7:
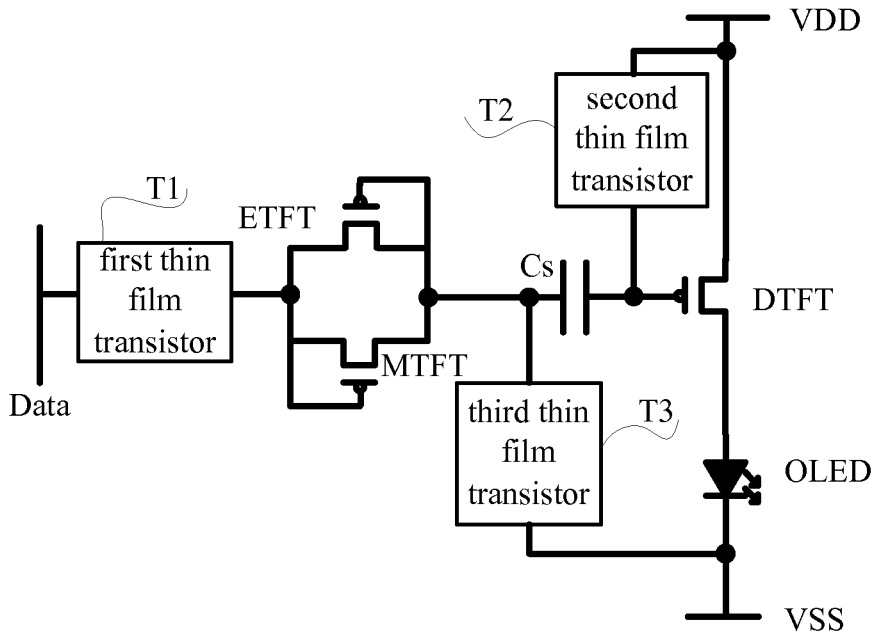
FIG. 7 is a circuit diagram of a pixel unit driving circuit according to a fifth embodiment of the present disclosure.

As illustrated in FIG. 7, in the pixel unit driving circuit according to a fifth embodiment of the present disclosure, the charging control unit 61 comprises a first thin film transistor T1 and a second thin film transistor T2, and the driving control unit comprises a third thin film transistor T3;

the gate and the source of the matching thin film transistor MTFT, the drain of the signal-erasing thin film transistor ETFT are connected with the data line Data via the first thin film transistor T1;

the gate of the driving thin film transistor DTFT is connected with the high level output terminal of the driving power supply via the second thin film transistor T2;

the second end of the storage capacitor Cs is connected with the low level output terminal of the driving power supply via the third thin film transistor T3.

Figure 8:
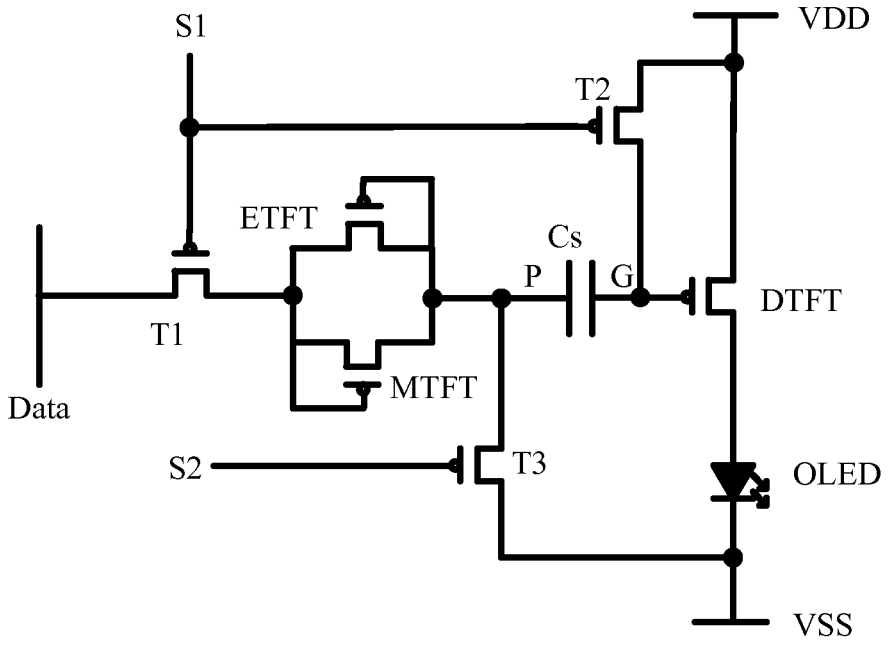
FIG. 8 is a circuit diagram of a pixel unit driving circuit according to a sixth embodiment of the present disclosure.

As illustrated in FIG. 8, in the pixel unit driving circuit according to a sixth embodiment of the present disclosure, the first thin film transistor T1, the second thin film transistor T2 and the third thin film transistor T3 are p-type TFTs;

a gate of the first thin film transistor T1 is connected with a first control line for outputting a first control signal S1, and a source thereof is connected with the data line Data;

a drain of the first thin film transistor T1 is connected with the gate and the source of the matching thin film transistor MTFT, and the drain of the signal-erasing thin film transistor ETFT, respectively;

a gate of the second thin film transistor T2 is connected with the first control line, a source thereof is connected with the high level output terminal of the driving power supply, and a drain thereof is connected with the gate of the driving thin film transistor DTFT;

a gate of the third thin film transistor T3 is connected with a second control line for outputting a second control signal S2, a source thereof is connected with the second end of the storage capacitor Cs, and a drain thereof is connected with the low level output terminal of the driving power supply.

Below will explain an operation process of the pixel unit driving circuit according to the third embodiment of the present disclosure.

Figure 10:
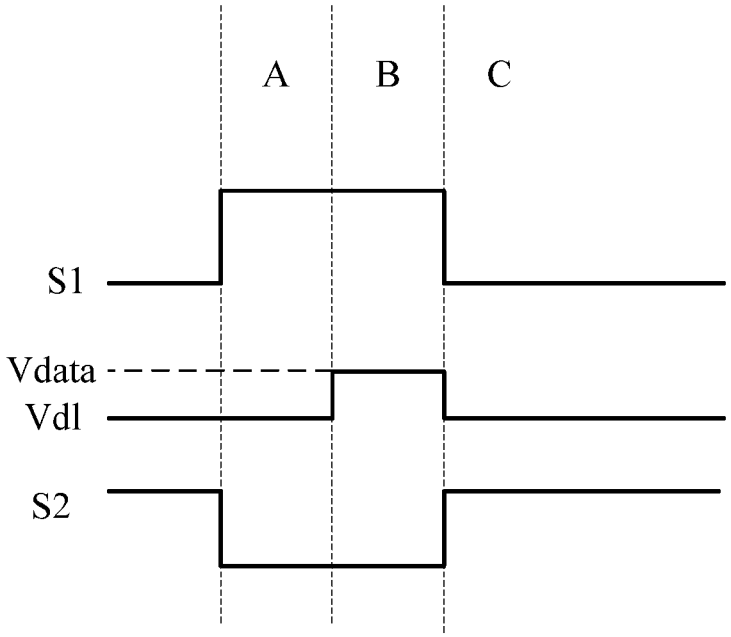
FIG. 10 is a timing diagram illustrating a first control signal S1, a signal output from a data line Data and a second control signal S2 when the pixel unit driving circuit according to the third embodiment of the present disclosure operates.

FIG. 10 is a timing diagram illustrating a first control signal S1, a signal output from a data line Data and a second control signal S2 when the pixel unit driving circuit according to the third embodiment of the present disclosure operates, wherein A, B and C refer to a first period of time, a second period of time and a third period of time, respectively.

FIG. 10 illustrates that the pixel unit driving circuit according to the third embodiment of the present disclosure operates.

Figure 9A:
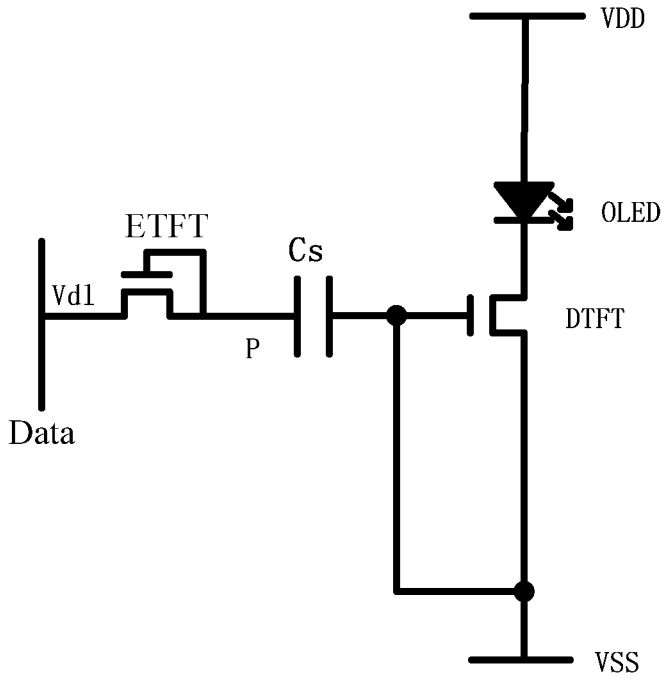
FIG. 9A is an equivalent circuit diagram of the pixel unit driving circuit according to the third embodiment of the present disclosure when it operates during a first period of time.

During the first period of time, that is, an initialization stage, as illustrated in FIG. 9A, both of the T1 and T2 are turned on, T3 is turned off, and the data line Data inputs a very low voltage Vd1 since the T1 is turned on; the ETFT is turned on as the ETFT is connected as a diode and a previous signal voltage is much greater than the Vd1. At this time, since the T2 is turned on, the gate of the DTFT is pulled-down to VSS and thus the DTFT is turned off; since the ETFT is turned on, the storage capacitor Cs discharges the data line Data through the ETFT so as to erase signals of a previous frame until a potential Vp at a P point (that is, a node connected with the second end of the storage capacitor Cs) is Vd1+Vthe, then the ETFT is turned off.

Figure 9B:
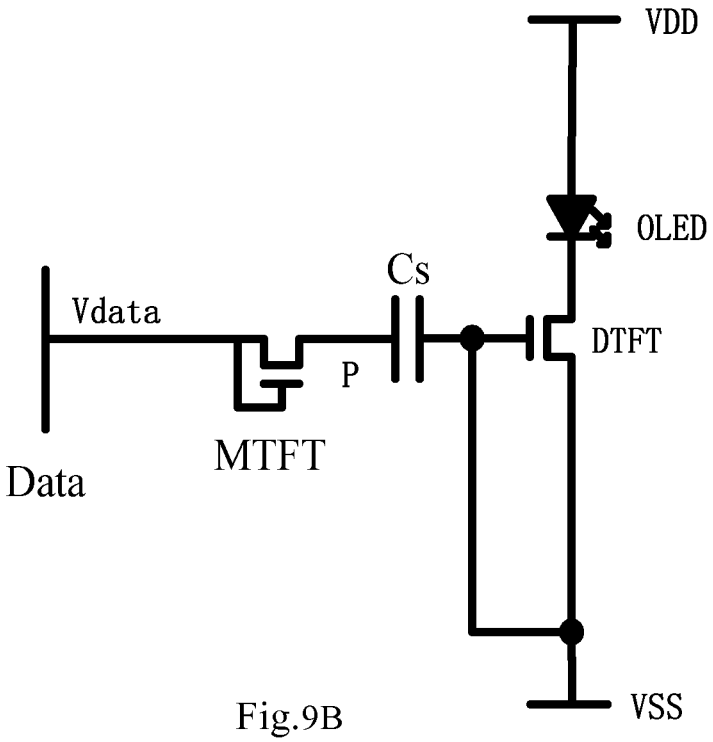
FIG. 9B is an equivalent circuit diagram of the pixel unit driving circuit according to the third embodiment of the present disclosure when it operates during a second period of time.

Next, during the second period of time, as illustrated in FIG. 9B, both of the T1 and T2 are turned on, T3 is turned off. The DTFT is turned off since the gate thereof is pulled down, and thus is in a non-operation state; the voltage output from the data line Data jumps to Vdata from Vd1, therefore the MTFT is turned on since Vdata is much greater than Vd1, and the data voltage Vdata output from the data line Data charges the storage capacitor Cs until the potential at the P point rises to Vdata−Vthm, thus Vc=Vg−Vp=VSS−(Vdata−Vthm) at this time.

Figure 9C:
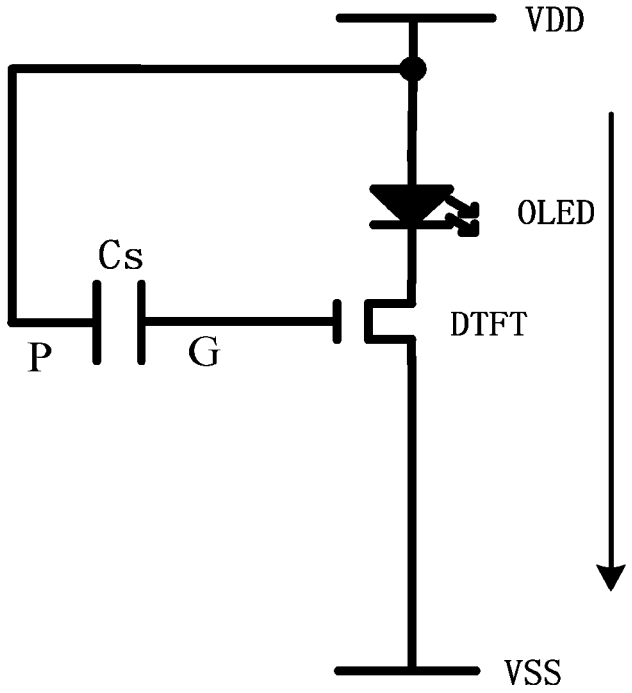
FIG. 9C is an equivalent circuit diagram of the pixel unit driving circuit according to the third embodiment of the present disclosure when it operates during a third period of time.

During the third period of time, as illustrated in FIG. 9C, both of the T1 and T2 are turned off, the T3 is turned on. The T2 is turned off since the potential at the P point jumps to VDD from Vdata−Vthm, and the gate of the DTFT is in the float state, so that a potential Vg at a G point (that is, a node connected with the gate of the DTFT and the first end of the storage capacitor Cs) jumps Vg=VSS−(Vdata−Vthm)+VDD, and at this time, Vgs=Vg−VSS=VSS−(Vdata−Vthm)+VDD−VSS=VDD−(Vdata−Vthm); the DTFT operates, so a current flowing through the DTFT is $I=K(Vgs-Vthd)^2=K(VDD-(Vdata-Vthm)-Vthd)^2=K(VDD-Vdata)^2$, wherein Vthm=Vthd; then the OLED starts to emit light until a next frame.

Vthm is a threshold voltage of the MTFT, Vgs is a gate-source voltage of the DTFT, Vthd is a threshold voltage of the DTFT, Vthe is a threshold voltage of the ETFT, Vdata is a data voltage, VDD is an output voltage at the high level output terminal of the driving power supply, and VSS is an output voltage at the low level output terminal of the driving power supply.

It can be seen that the current I flowing through the DTFT is independent of the threshold voltage Vth of the DTFT, thus a uniformity in the current may be improved and in turn a uniformity in brightness may be acquired.

Figure 11:
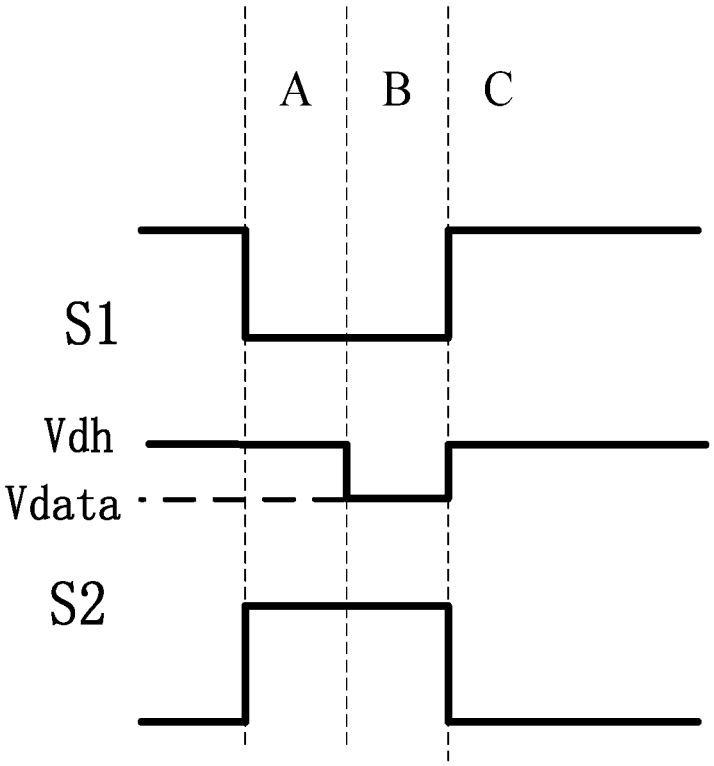
FIG. 11 is a timing diagram illustrating a first control signal S1, a signal output from a data line Data and a second control signal S2 when the pixel unit driving circuit according to the sixth embodiment of the present disclosure operates.

FIG. 11 is a timing diagram illustrating a first control signal S1, a signal output from a data line Data and a second control signal S2 when the pixel unit driving circuit according to the sixth embodiment of the present disclosure operates, wherein A, B and C refer to a first period of time, a second period of time and a third period of time, respectively.

FIG. 11 illustrates that the pixel unit driving circuit according to the six embodiment of the present disclosure operates.

During the first period of time, both of the T1 and T2 are turned on, T3 is turned off, the gate of the DTFT is pulled to VDD and thus the DTFT is turned off; at this time, the voltage on the data line is Vdh which is a voltage being higher than all of Vdata, the ETFT is turned on since the ETFT is connected as a diode, and the potential Vp at the P point is charged to Vdh−|Vthe|, then the ETFT is turned off.

During the second period of time, both of the T1 and T2 are turned on, T3 is turned off. The voltage on the data line jumps to Vdata from Vdh, therefore the MTFT is turned on, since Vdata is much lower than Vdh, which renders the MTFT is connected as a diode. The P point discharges the data line through the MTFT until the potential at the P point drops to Vdata+|Vthm|, the MTFT is turned off at this time.

During the third period of time, both of the T1 and T2 are turned off, the T3 is turned on. The gate of the DTFT is in the float state and the potential at the P point jumps to VSS from Vdata+|Vthm|, therefore the potential Vg at the G point also jumps to Vg=VDD+VSS−(Vdata+|Vthm|), and a voltage difference between the source and the gate of the DTFT is Vsg=VDD−Vg=Vdata+|Vthm|−VSS; the current flowing through the DTFT is $I=K(Vsg-|Vthd|)^2=(Vdata+|Vthm|-VSS-|Vthd|)^2=(Vdata-VSS)^2$, wherein Vthm=Vthd; then the OLED starts to emit light until a next frame.

Wherein Vthm is a threshold voltage of the MTFT, Vsg is a voltage difference between the source and the gate of the DTFT, Vthd is a threshold voltage of the DTFT, Vthe is a threshold voltage of the ETFT, Vdata is a data voltage, VDD is an output voltage at the high level output terminal of the driving power supply, and VSS is an output voltage at the low level output terminal of the driving power supply.

A greatest advantage of the pixel unit driving circuit according to the present disclosure is to compensate a critical voltage of the OLED driving transistor with a principle that electrical properties of two TFTs designed similarly in a same pixel match to each other. In particularly, the two TFTs designed similarly inside the same pixel have a very identical process environment because they are located very closely, even if the current process conditions are imperfect, and thus variance in their electrical properties caused by the processes is very small and may be neglected, that is, the threshold voltage Vthm of the matching thin film transistor is the same as the threshold voltage Vthd of the driving transistor DTFT.

It should understand that, the above are only exemplary embodiments of the disclosed present invention, but the scope sought for protection is not limited thereto. Instead, it should be appreciated for those skilled in the art that many modifications, variants or equivalents can be made without departing from the spirits and the scope as defined by the attached claims, and all of them would fall into the protection scope of the present invention.

What is claimed is:

1. A pixel unit driving circuit for driving an organic light emitting diode (OLED), comprising a driving thin film transistor, a matching thin film transistor, a signal-erasing thin film transistor, a charging control unit, a driving control unit and a storage capacitor, wherein the charging control unit comprises a first thin film transistor and a second thin film transistor:

a gate of the driving thin film transistor is connected with a first end of the storage capacitor and is connected with a low level output terminal of a driving power supply only via the second thin film transistor, a source thereof is connected with the low level output terminal of the driving power supply directly, and a drain thereof is connected with a cathode of the OLED;

a gate and a drain of the matching thin film transistor are connected with a data line via the first thin film transistor, and a source thereof is connected with a second end of the storage capacitor;

a gate and a drain of the signal-erasing thin film transistor are connected with the second end of the storage capacitor, a source of the signal-erasing thin film transistor is connected with the gate and the drain of the matching thin film transistor, and is connected with the data line via the first thin film transistor;

the second end of the storage capacitor is connected with a high level output terminal of the driving power supply via the driving control unit, and an anode of the OLED is connected to the high level output terminal of the driving power supply; and the driving thin film transistor, the matching thin film transistor and the signal-erasing thin film transistor are n-type TFTs;

wherein a gate of the second thin film transistor is connected with the first control line, a source thereof is connected with the low level output terminal of the driving power supply, and a drain thereof is connected with the gate of the driving thin film transistor; and the second thin film transistor is configured to pull down a potential of the gate of the driving thin film transistor so as to turn off the driving thin film transistor during a non-light-emitting period of the OLED.

2. The pixel unit driving circuit of claim 1, wherein the driving control unit comprises a third thin film transistor;

the second end of the storage capacitor is connected with the high level output terminal of the driving power supply via the third thin film transistor.

3. The pixel unit driving circuit of claim 2, wherein the first thin film transistor, the second thin film transistor and the third thin film transistor are n-type TFTs;

a gate of the first thin film transistor is connected with a first control line, and a drain thereof is connected with the data line;

a source of the first thin film transistor is connected with the gate and the drain of the matching thin film transistor, and the source of the signal-erasing thin film transistor, respectively;

a gate of the third thin film transistor is connected with a second control line, a source thereof is connected with the second end of the storage capacitor, and a drain thereof is connected with the high level output terminal of the driving power supply.

4. A pixel unit driving method, applied to the pixel unit driving circuit of claim 1, comprising the steps of:

controlling the charging control unit so that the signal-erasing thin film transistor is turned on and the storage capacitor discharges the data line through the signal-erasing thin film transistor until a voltage at the second end of the storage capacitor drops so as to turn off the signal-erasing thin film transistor, and controlling the charging control unit so that the gate of the driving thin film transistor is pulled-down to a voltage (VSS) output from the low level output terminal of the driving power supply;

controlling the charging control unit, so that the matching thin film transistor is turned on and a data voltage (Vdata) output from the data line charges the storage capacitor until the voltage at the second end of the storage capacitor rises to be equal to a voltage difference (Vdata−Vthm) between the data voltage and a threshold voltage of the matching thin film transistor; and controlling the driving control unit so that the voltage at the second end of the storage capacitor is pulled-up to a voltage (VDD) output from the high level output terminal of the driving power supply, and controlling the charging control unit so that the gate of the driving thin film transistor is in a float state so as to turn on the driving thin film transistor.

* * * * *